US006702131B2

(12) United States Patent
Hanamoto

(10) Patent No.: US 6,702,131 B2
(45) Date of Patent: Mar. 9, 2004

(54) CONSTRUCTION MACHINE

(75) Inventor: Takahiro Hanamoto, Akashi (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 92 days.

(21) Appl. No.: 09/852,724

(22) Filed: May 11, 2001

(65) Prior Publication Data

US 2002/0008230 A1 Jan. 24, 2002

(30) Foreign Application Priority Data

May 11, 2000 (JP) ..... 2000-138286

(51) Int. Cl.[7] ..... B66C 23/06

(52) U.S. Cl. ..... 212/232; 212/231; 212/239; 212/262

(58) Field of Search ..... 212/239, 240, 212/262, 230, 231, 232

(56) References Cited

U.S. PATENT DOCUMENTS

| | | | | | |
|---|---|---|---|---|---|
| 2,734,641 | A | * | 2/1956 | Burton | 212/7 |
| 3,651,905 | A | * | 3/1972 | Brown | 192/17 A |
| 3,954,020 | A | * | 5/1976 | West et al. | 74/410 |
| 4,391,477 | A | * | 7/1983 | Morrow, Sr. | 308/221 |
| 5,035,337 | A | * | 7/1991 | Juergens | 212/196 |
| 5,484,069 | A | * | 1/1996 | Lanning | 212/270 |
| 5,586,667 | A | * | 12/1996 | Landry | 212/196 |
| 5,711,440 | A | * | 1/1998 | Wada | 212/278 |

FOREIGN PATENT DOCUMENTS

| | | |
|---|---|---|
| EP | 0 997 428 | * 10/1999 |
| JP | 57-166288 | 10/1982 |
| JP | 58-195625 | 11/1983 |
| JP | 63-42691 | 3/1988 |
| JP | 1-34917 | 7/1989 |
| JP | 2-4891 | 1/1990 |
| JP | 7-323992 | * 12/1995 |
| JP | 10-101292 | 4/1998 |

* cited by examiner

*Primary Examiner*—Thomas J. Brahan
(74) *Attorney, Agent, or Firm*—Oblon, Spivak, McClelland, Maier & Neustadt, P.C.

(57) ABSTRACT

The present invention provides a construction machine in which a plurality of winches are arranged to be overlapped vertically at a rear part of an upper rotating body. Therefore, a space that the winches occupy is reduced, so that the space of the upper rotating body can be utilized effectively, and a radius of rotating rear end can be reduced.

12 Claims, 8 Drawing Sheets

CONSTRUCTION MACHINE

BACKGROUND OF THE INVENTION

1. Field of the Invention

The present invention relates to a construction machine including winches.

2. Description of the Related Art

A crawler crane that is a kind of mobile crane will be explained. FIG. 7 shows a lattice boom crawler crane "hereinafter, can be referred to as LBCC" and FIG. 8 shows a telescoping boom crawler crane "hereinafter, an be referred to as TBCC". Numeral 1 is a crawler type of a lower traveling body. An upper rotating body 3 is mounted on the lower traveling body 1 via a rotation bearing 2 rotatably around a longitudinal axis. In the upper rotating body 3, a lattice boom 4 is provided in FIG. 7, and a telescoping boom 5 is provided in FIG. 8, to freely raise and lower, respectively.

As a means for making the booms 4, 5 raise and lower, a boom up-and-down rope 6 and a first winch 7 for winding and rewinding the rope 6 are provided in LBCC, and a boom up-and-down cylinder 8 is provided in TBCC.

As lifting means for a lifting work, a second "main" winch 9 and a third "auxiliary" winch 10 are provided in the upper rotating body 3 of LBCC and a first "main" winch 11 and a second "auxiliary" winch 12 are provided in the upper rotating body 3 of TBCC. A main hook 14 is suspended to rise and fall by means of a main rope 13 taken from the main winches 9, 11, and a sub hook 16 is suspended to rise and fall by means of a auxiliary rope 15 taken from the auxiliary winches 10, 12.

In such mobile cranes, in order to improve work efficiency at a small space, it is preferable that a radius R of a rotating rear end is as small as possible.

In FIGS. 7 and 8, a plurality of winches is arranged horizontally by side by side in the upper rotating body 3 in order to facilitate the winding and rewinding of the ropes winded on the winches. Therefore, a horizontal space that the winches occupy increases.

Also, because the rope-winding capacity of winch increases as the lifting ability is set to be great, the horizontal space that the winches occupy further increases.

Therefore, arranging efficiency of the whole space in the upper rotating body is deteriorated, and it was difficult to secure a space for arranging other machinery "engine, hydraulic equipment, operation oil tank, fuel tank and the like". Also, in order to secure the space, a radius R of the rotating rear end increased.

Particularly, in TBCC of FIG. 8, in addition to the need for improving the lifting ability in a limited space "to set a great lifting ability at a small work radius", so as to reduce the overhanging amount of the boom 5 in transit, an up-and down swinging axis is arranged rearward of the center of rotation of the rotating body 3. Also, because the mounting point of the boom up-and-down cylinder 8 is positioned at the vicinity of the center of rotation of the rotating body, the space for arranging the winches cannot be secured at the center part of rotation. As a result, the winches 11, 12 must be arranged at the rear part of the rotating body. Because the space that the winches occupy is great horizontally at the rear part of the rotating body, the radius R of the rotating rear end becomes greater.

SUMMARY OF THE INVENTION

An object of the present invention is to provide a construction machine in which a space that winches occupy can be reduced without decrease of workability, so that a space of an upper rotating body can be utilized effectively. Particularly, the object of the present invention is to provide a construction machine in which a space for arranging other equipment can be easily secured in a mobile crane of which the whole size is limited.

The construction machine of the present invention has the following constitution.

The construction machine comprises a lower traveling body, an upper rotating body which is mounted rotatably on said lower traveling body, and winches provided at rear part of said upper rotating body, wherein at least two of said winches are arranged to be overlapped vertically with each other.

In this case, because at least two of said winches are arranged to be overlapped vertically with each other, a horizontal space that the winches occupy can be reduced to secure a space for arranging other equipment. Therefore, because a limited space of the upper rotating body can be utilized effectively in a mobile crane of which the whole size is limited, the layout of other equipment can be facilitated.

Because the space that the winches occupy can be reduced at the rear part of the upper rotating body, the radius R of the rotating rear end "distance from center of rotation to rear end of the upper rotating body" can be reduced.

Also, because the center of gravity of the construction machine can be deviated backward, the workability can be improved. That is, the lifting ability in the crane and the attachment supporting ability in earth-moving machine can be increased.

DESCRIPTION OF THE PREFERRED EMBODIMENTS

Now, preferred embodiments of the present invention will be described with reference to FIGS. 1 to 6. However, the present invention is not limited to the embodiments.

Figure 1:
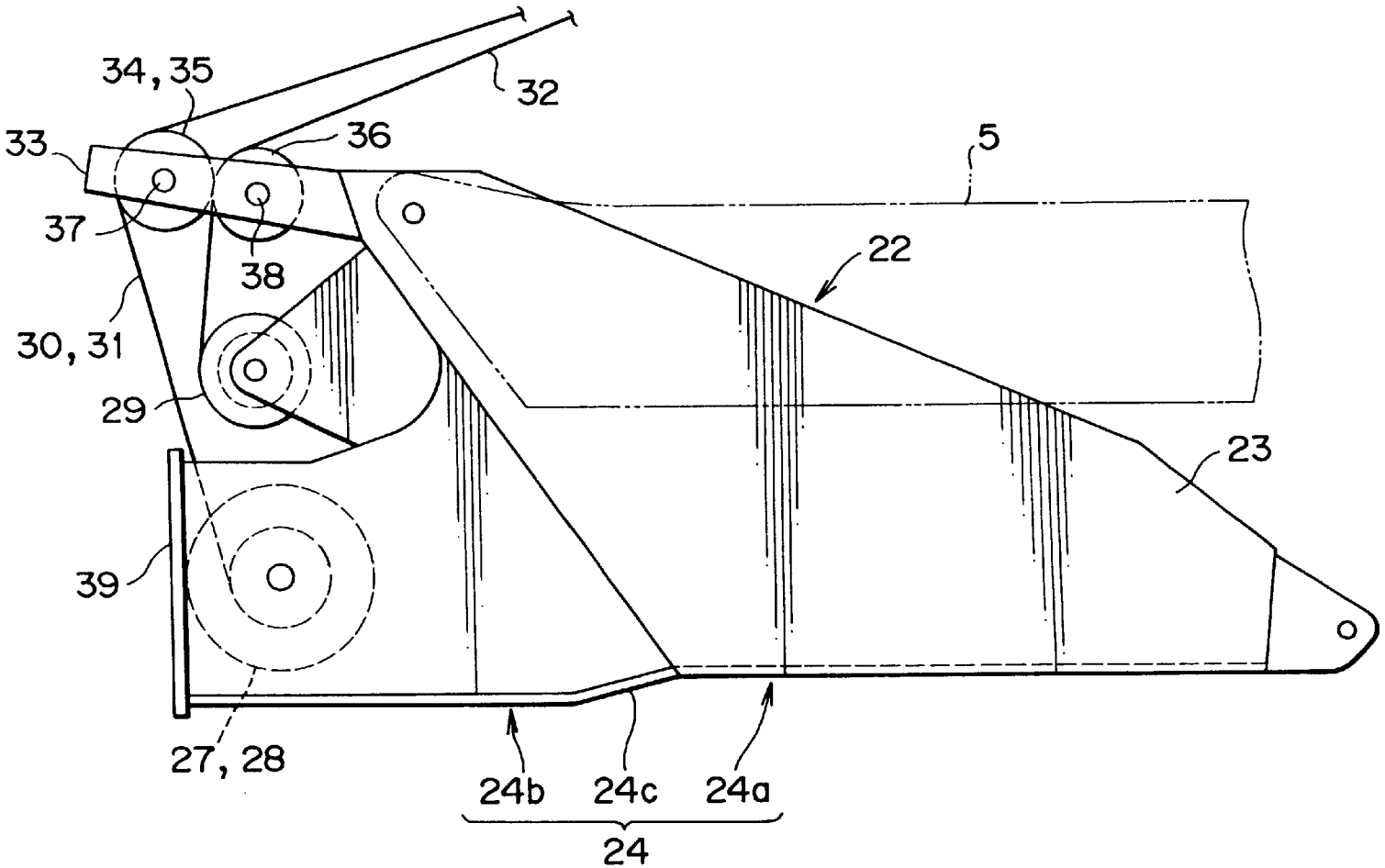
FIG. 1 is a side view of a rotating frame and a part in which winches are arranged, in a telescoping boom crawler crane according to a first embodiment of the present invention.
Figure 2:
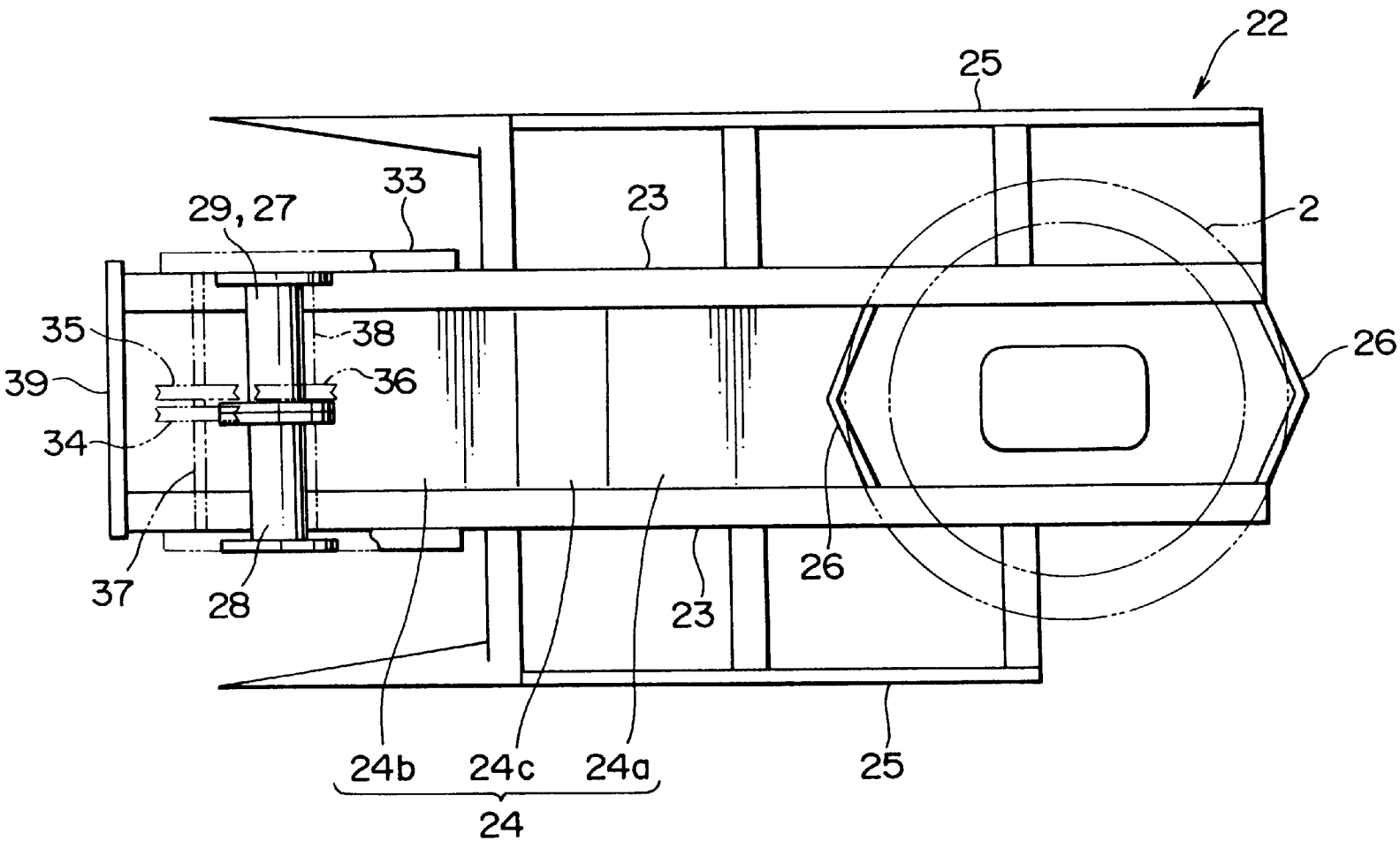
FIG. 2 is a plane view of FIG. 1.
Figure 3:
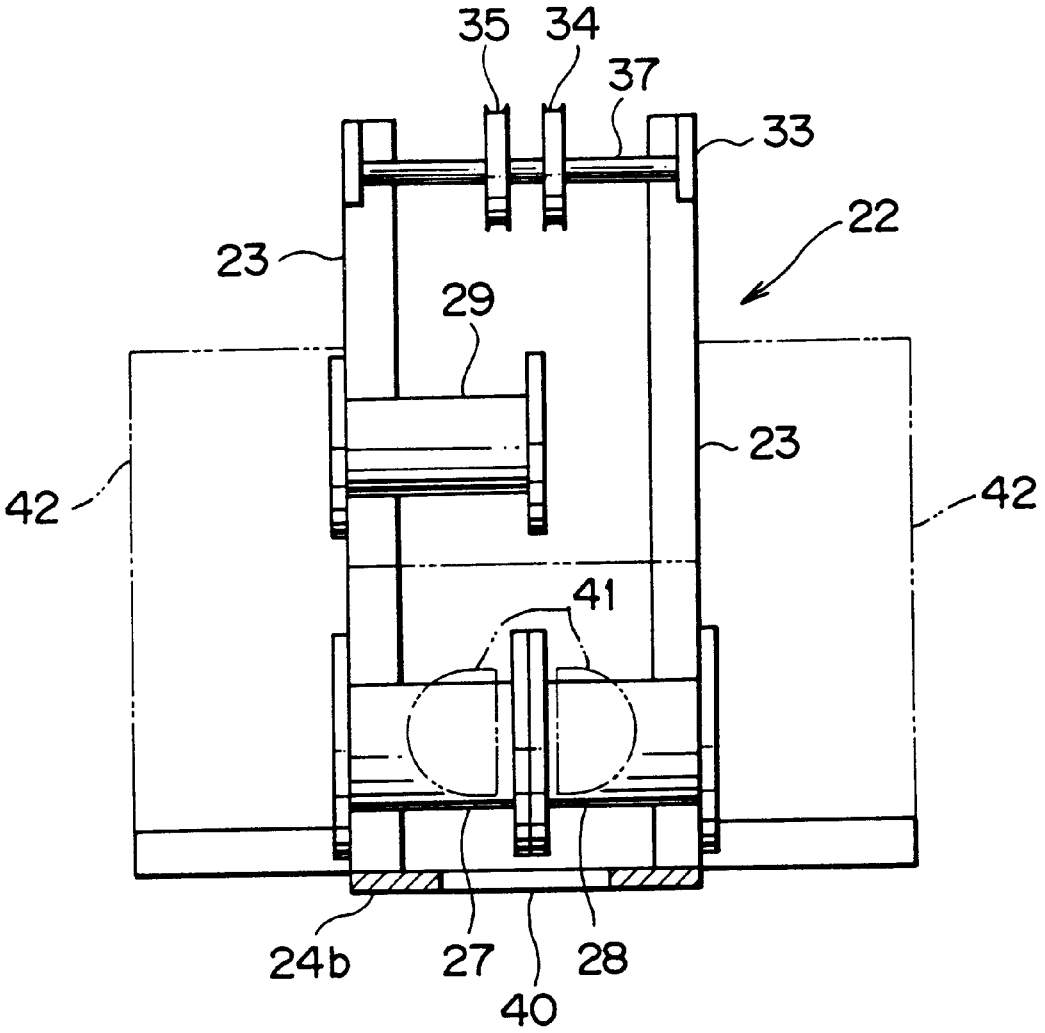
FIG. 3 is a back view of a partial cross-section of FIG. 1.

First Embodiment "Refer to FIGS. 1 to 3"

Figure 7:
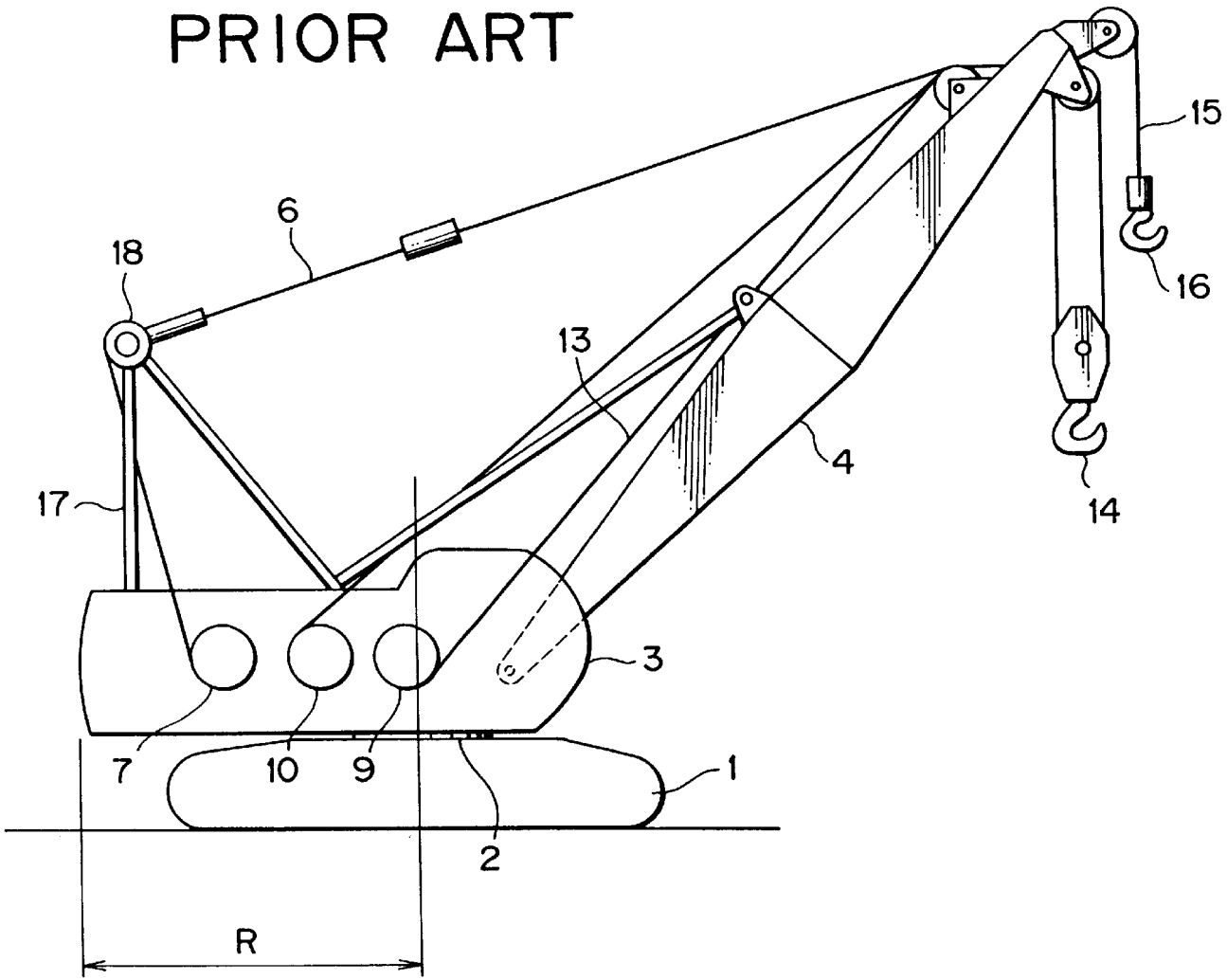
FIG. 7 PRIOR ART
FIG. 7 is a side view representing the conventional arrangement of winches in the lattice boom crawler crane.
Figure 8:
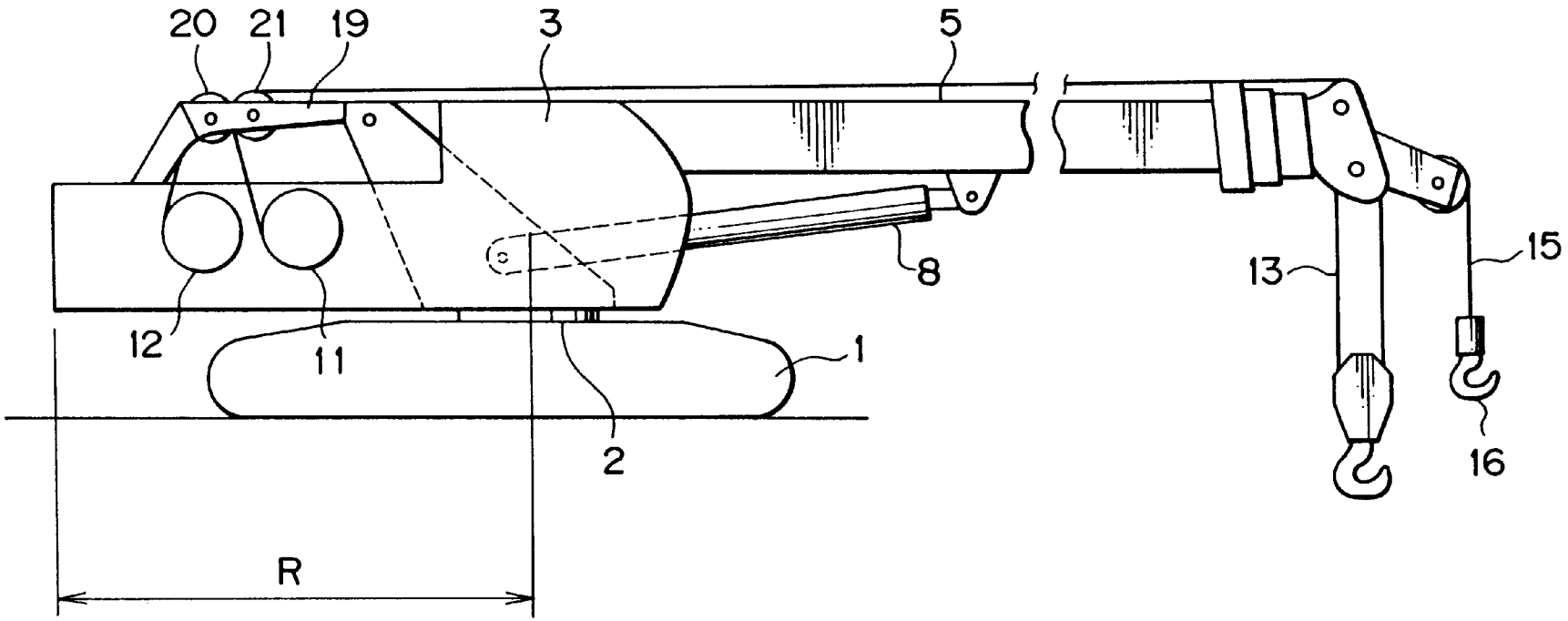
FIG. 8 PRIOR ART
FIG. 8 is a side view representing the conventional arrangement of winches in the telescoping boom crawler crane.

This embodiment exemplifies TBCC having a telescopic boom expandable and contractible telescopically shown in FIG. 8. In FIG. 8, 19 is a gantry guiding a main and an auxiliary ropes 13, 15, and 20 and 21 are guide sheaves for the ropes. In the meantime, in FIG. 7, 17 is a gantry for raising and lowering a boom for guiding a boom up-and-down rope 6, and 18 is a gantry sheave for the rope.

In FIGS. 1 to 3, 22 is a frame "rotating frame" constituting an upper rotating body. With the rotating frame 22, a boom 5 is provided, and, additionally, each equipment is provided to form the upper rotating body.

The rotating frame 22 includes: a pair of main frames 23, 23 "as shown, an exterior appearance with a shape of an approximate triangle in a case of taking a side view thereof, sloping upward to rear surface thereof" arranged in parallel to each other with a gap for sandwiching the base end of the boom 5; a bottom plate 24 provided between lower surfaces of the main frames 23, 23; auxiliary frames 25, 25 having a shape of a ladder, which are mounted projecting outward from the main frames 23, 23; a pair of front and rear reinforcing frames 26, 26 spread between both main frames 23, 23 at the front part of the rotating frame.

The reinforcing frames 26, 26, as shown in FIG. 2, have dog-leg shapes when viewed from a plane along the rotation bearing 2, and are provided on outer side of the upper surface of the rotation bearing 2.

Such arrangement of the reinforcing frames 26, 26 makes bolts "not shown" for connection of the rotation bearing 2 be arranged around the whole circumference of the bearing in equal pitches without interruption of the frames 26, 26. Also, boom load is widely dispersed and transmitted from the main frames 23, 23 to the rotation bearing 2 and then the lower traveling body through the reinforcing frames 26, 26. Therefore, load is not concentrated on a specific part of the construction machine.

As shown in FIG. 1, the bottom plate 24 of the rotating frame comprises the front bottom plate 24*a*, the oblique stepwise part 24*c* and the rear bottom plate 24*b*. Those plates 24*a* to 24*c* are continuously positioned such that the rear bottom plate 24*b* is lower than the front bottom plate 24*a* and is at the rear of the plate 24*a* positioned between the main frames 23, 23, through the stepwise part 24*c* sloping downward backwards. The winches are equipped to be overlapped vertically to form two-stages, at the upper part of the lowered rear bottom plate 24*b*.

The first embodiment exemplifies 3 winches mechanism consisting of a first, a second and a third winches 27, 28, and 29. On the rear bottom plate 24*b*, both of the first and the second winches 27, 28 "for example, a main and an auxiliary winches" including a winch drum that has large diameter and on which a thick and long rope is wound in multi-layers, are arranged transversely side by side and coaxially at lower end side. The third winch 29 "for example, a winch for auxiliary work such as hanging a pile" is arranged above the first winch 27.

Also, the third winch 29 is mounted at the vicinity of the rear part of the boom 5, namely, above the back side of the main frames 23, 23 by means of brackets for equipping the winch.

A first, second and third ropes 30, 31, 32 taken from the respective winches 27, 28, 29 are guided to front part of the boom via the respective guide sheaves 34, 35, 36 of the gantry 33 provided between the main frames 23, 23 of the rotating frame 22.

Also, the hydraulic motors and the reduction gears as driving source of the respective winches 27, 28, 29 are not shown here.

Also, the guide sheaves 34, 35, 36 are divided into a set of two and a set of one, and are provided on two sheave shafts 37, 38 so that bi-axial type is illustrated, When two winches, for example, the second and the third winches 28, 29 in FIGS. 1 and 2 are arranged in two-stages vertically, it may be one-shaft type in which the guide sheaves 34, 36 are provided on one sheave shaft.

Like this, because three winches 27, 28, 29 are arranged in a form that two winches 27, 28 at lower side and one 29 at upper side are overlapped with each other, the horizontal space that the winches 27, 28, 29 occupy can be reduced drastically. Therefore, the space for arranging other equipment can be easily secured.

Also, because the horizontal space for arranging the winches at the rear part of the rotating body can be reduced, the radius of the rotating rear end of the crane can be reduced.

Further, because the center of gravity of the crane can be deviated backward according to the vertical arrangement of the winches, the workability of the crane can be improved.

In addition, it is preferable that the bottom surface of the rear part of the rotating frame is stepwise lower than the bottom surface of the front part of the rotating frame.

In this case, the winches can be provided at the lower part, so that the center of gravity of the rear part of the machine can be lowered to further improve the workability. Also, because the vertical space gets broader, a plurality of winches can be arranged vertically without difficulties.

Also, it is preferable that the lower end of the lowest winch of a plurality of winches vertically overlapped is positioned at lower part than the bottom surface of the front part of the rotating frame.

Specifically, the rotating frame is formed such that the rear bottom plate 24*b* of the rotating frame has a lower part than the front bottom plate 24*a*, and the winches 27, 28, 29 are arranged at the lower part. Therefore, the center of gravity of the rear part of the crane is lowered to improve the workability, and simultaneously, the vertical space of the rear part of the rotating body can be broader to arrange the winches 27, 28, 29 vertically without difficulties.

It is preferable that an opening that makes the winches face outward is formed at the rear bottom or the back surface of the rotating frame.

In this case, assembling or repairing of the winch arranged at lower position "particularly, the lower winch of the winches arranged vertically" can be easily carried out by means of the opening formed at the bottom surface of the rear part or the back surface of the rotating frame.

As shown in FIG. 3, openings 40, 41 that make the first winch 27 and the second winch 28 face outward are formed in the rear bottom plate 24*b* of the rotating frame and in the end plate 39 formed at rear end surface of the rotating frame A assembling, repairing or checkup of the lower winches 27, 28 not reached from the upper side can be easily carried out from the outside by means of the openings 40, 41.

In FIG. 3, 42 is a guard for covering equipment "not shown" such as the engine, the pump, the operation oil, the fuel tank, the valve unit and the like loaded in the rotating frame 22.

Second Embodiment

In the first embodiment, two winches of three winches 27, 28, 29 are arranged at the lower part, and one winch is arranged at the upper part. However, in the second embodiment shown in FIG. 4, three winches 27, 28, 29 may be arranged vertically to form three-stages.

In this case, because transverse space for arranging the winches can be reduced, the layout of other equipment can be further facilitated.

As shown in the drawing, under the condition that difference in capacity, namely difference in weight "difference in diameter" of the respective winches 27, 28, 29 exist, it is preferable that the winch with large diameter and weight "the first winch 27 in the drawings" is arranged at the lowest part, and the winches with small diameter and weight "the second and the third winches 28, 29 in the drawings" are arranged at upper part sequentially.

Figure 4:
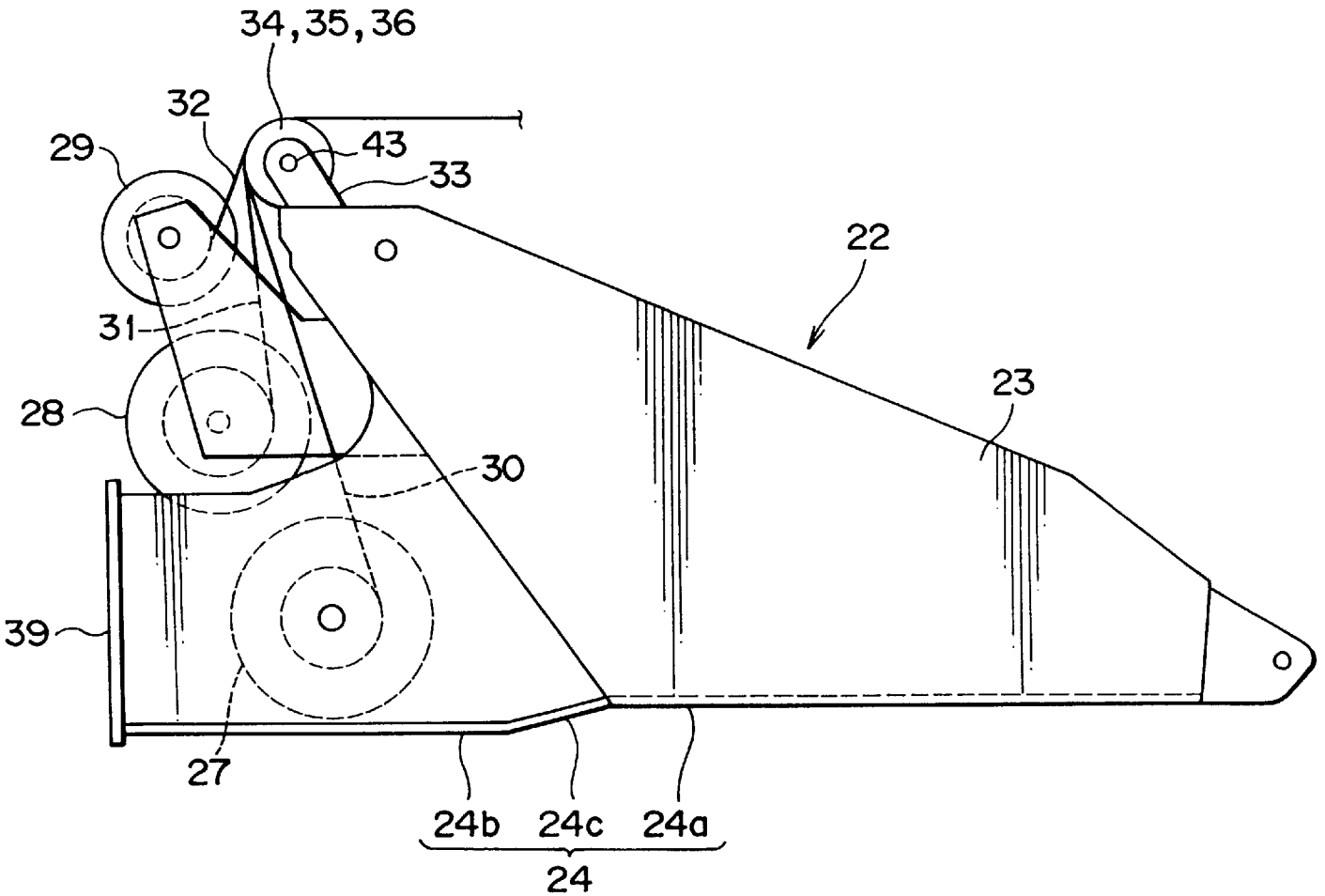
FIG. 4 is a drawing corresponding to FIG. 1, according to a second embodiment of the present invention.
Figure 5:
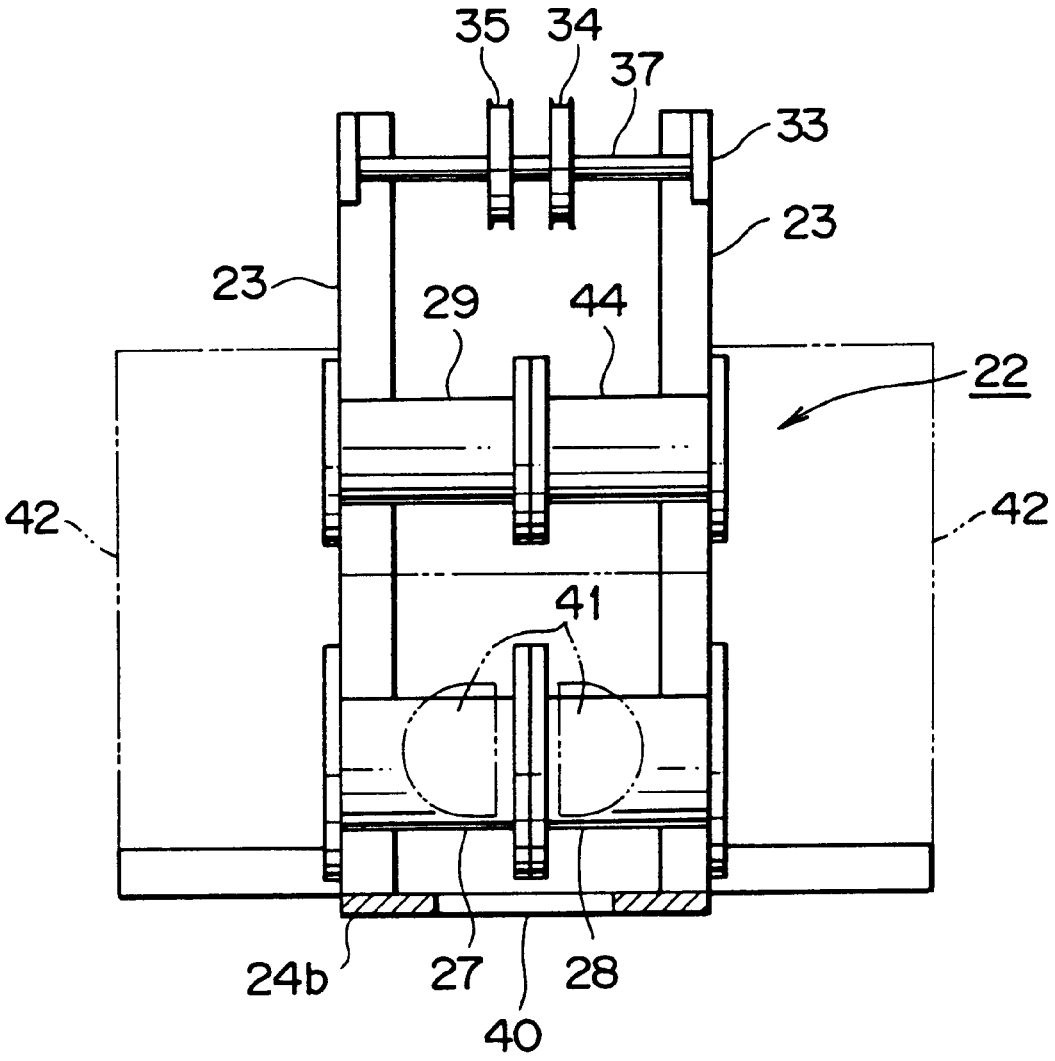
FIG. 5 is a drawing corresponding to FIG. 3, according to a third embodiment of the present invention.

In this arrangement, because the winch with large capacity and weight among a plurality of winches is arranged at lower part, the center of gravity of the rear part can be further lowered to improve the workability Also, the heavy winch, namely, the winch with large diameter that the capacity for winding the rope is greater is arranged at the lower part, and relatively, the winches with small diameter is arranged thereon. As a result, as shown in FIG. 4, horizontal steps are occurred between the vertical winches. By use of such steps, the rope can be easily taken from the lower winches 27, 28.

Also, a plurality of winches are arranged along the oblique back surface, of which the rear part is raised, of the main frame 23 having a shape of triangle roughly. As a result, the amount projected backward of the winches is small, and thus, the winches can be effectively arranged at the rear part of the rotating frame 22.

Also, FIG. 4 shows arrangement of the winches that said steps occur in the front "main frame 23 side". On the other hand, arrangement of the winches that the steps occur in the rear or arrangement of the winches having a zigzag shape that the steps occur in turn in the front and the rear may be employed.

Also, in FIG. 4, the case that one sheave shaft 43 is formed in the gantry 33, and three guide sheaves 34, 35, 36 are mounted on the sheave shaft 43 is illustrated.

Third Embodiment

The first and the second embodiments exemplify the case applied to three-winch type. The third embodiment shown in FIG. 5 exemplifies the case applied to a four-winch type comprising four winches 27, 28, 29, 44. Two winches of the winches 27, 28, 29, 44 are arranged at the upper part, and two winches are at the lower part, respectively.

As shown in FIG. 4, the openings 40, 41 that make the first winch 27 and the second winch 28 face outward are formed in the rear bottom plate 24*b* of the rotating frame and the end plate 39 "not shown" formed at rear end surface of the rotating frame. Assembling, repairing or checkup of the lower winches 27, 28 not reached from the upper side can be easily carried out from the outside by means of the openings 40, 41.

Fourth Embodiment

The present invention may be applied to the case that the number of the winches is not less than five and the case that the number of the winches is two. Also, in LBCC, TBCC shown in FIGS. 7 and 8, the number of winches increases and decreases according to the kind of work.

Figure 6:
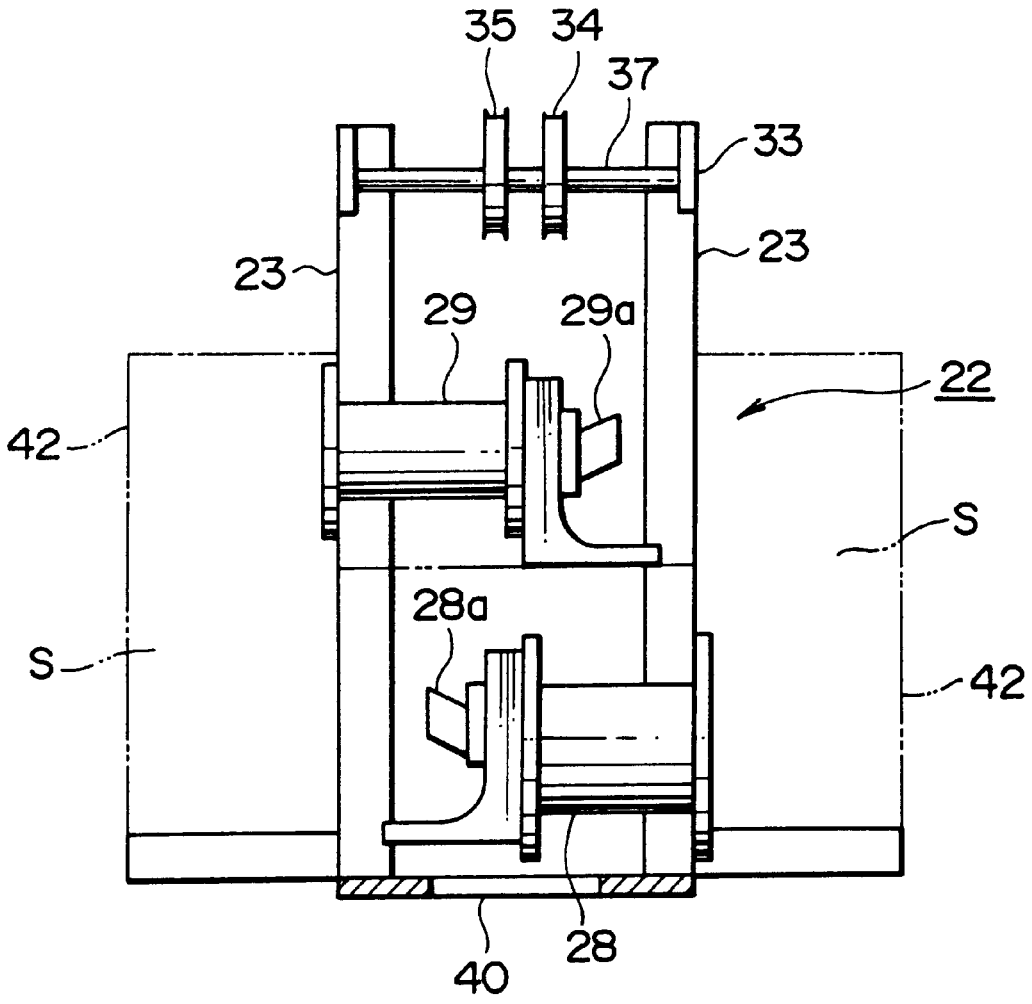
FIG. 6 is a drawing corresponding to FIG. 3, according to a fourth embodiment of the present invention.

In case where the number of the winches is two "two-winch type", as the fourth embodiment shown in FIG. 6, both winches "for example, the second and the third winches 28, 29 in the first embodiment" can be arranged to form two steps vertically and to be deviated horizontally at the center of the rear part of the rotating frame. In the space S of side part of both winches generated by means of the horizontal position deviation of the winches "in the lower space of the upper winch 29 and the upper space of the lower winch 28", each driving sources 28*a*, 29*a* "the hydraulic motors and the reduction gears" may be arranged.

Like this, weight of the winches including the driving sources 28*a*, 29*a* can be balanced, and both winches 28, 29 and the driving sources 28*a*, 29*a* can be nearly received between the main frames 23, 23, viewed from the back surface. Therefore, the amount of the winch parts projected to both sides can be restricted to be small. Thus, other equipment such as the hydraulic valve and the hydraulic pump for controlling the winches 28, 29 can be arranged in the space at side parts of the winches.

Fifth Embodiment

When a specific winch is not necessary, and thus, is removed, a counterweight "so-called dummy winch" corresponding to the removed winch can be mounted at the position from which the winch is removed.

Also, the shape of the rotating frame 22 is not limited to the shape described above and illustrated in the drawings, and can be appropriately changed according to the shape of the mounted boom and the capacity of the winch.

Also, the present invention is not limited to TBCC, and can be applied to LBCC shown in FIG. 7 and earth-moving machines such as excavator or pile driving machine, drilling machine and the like using the crane or the same base machine as the crane.

Also, in case where the number of the winches is not less than three, if at least two winches of them can be arranged to be overlapped with each other vertically, advantages of the present invention can be obtained. That is, the present invention is not limited to the construction machine that all winches are arranged vertically. In FIG. 1, the first winch 27 and the second winch 28 are arranged transversely side by side at the lower part, and however, only the third winch 29 is arranged upward of said winches 27, 28.

The embodiments of the construction machine according to the present invention are described above, but the scope of protection of the present invention is not limited to the embodiments. The present invention can be applied to any construction machine comprising winches.

I claim:

1. A construction machine, comprising:

a lower traveling body;

an upper rotating body mounted rotatably on said lower traveling body;

a boom arranged on said upper rotating body to be raised and lowered about a swinging axis, the swinging axis of said boom being arranged at a rearward portion of said upper rotating body;

winches arranged at the rearward portion of the upper rotating body, at least two winches of said winches being arranged to be overlapped vertically with each other; and guide sheaves for guiding guide ropes from said winches to a front part of said boom, wherein centers of rotation of all of said winches are arranged rearward of said swinging axis and below said guide sheaves.

2. A construction machine according to claim 1, wherein said upper rotating body includes a rotating frame and a rotation bearing provided at a bottom surface of a front part of said rotating frame, said rotation bearing supporting said upper rotating body rotatably.

3. A construction machine according to claim 2, wherein said winches are arranged at a rear part of said rotating frame.

4. A construction machine according to claim 3, wherein the bottom surface of the rear part of said rotating frame is lower than the bottom surface of the front part of said rotating frame.

5. A construction machine according to claim 3, said winches comprise a first winch and a second winch, said first winch and said second winch being arranged to form two-stages vertically and to be deviated laterally each other in the rear part of said rotating frame.

6. A construction machine according to claim 2, wherein an opening to make said winches face outward is arranged at the bottom surface of a surface of the rear part of said rotating frame.

7. A construction machine according to claim 1, a winch having greater capacity among said winches is arranged below a winch, having a smaller capacity.

8. The construction machine according to claim 1, wherein all of said winches are vertically overlapped with each other.

9. A construction machine, comprising:

a lower traveling body;

an upper rotating body mounted rotatably on said lower traveling body;

a boom arranged on said upper rotating body to be raised and lowered about a swinging axis, the swinging axis of said boom being arranged at a rearward portion of said upper rotating body;

winches arranged at the rearward portion of the upper rotating body, at least two winches of said winches being arranged to be overlapped vertically with each other; and guide sheaves for guiding guide ropes from said winches to a front part of said boom, wherein centers of rotation of all of said winches are arranged rearward of said swinging axis and below said guide sheaves, wherein said upper rotating body includes a rotating frame and a rotation bearing provided at a bottom surface of a front part of said rotating frame, said rotation bearing supporting said upper rotating body rotatably, wherein said winches are arranged at a rear part of said rotating frame, and wherein a bottom surface of the rear part of said rotating frame is lower than the bottom surface of the front part of said rotating frame.

10. A construction machine, comprising:

a lower traveling body;

an upper rotating body mounted rotatably on said lower traveling body;

a boom arranged on said upper rotating body to be raised and lowered about a swinging axis, the swinging axis of said boom being arranged at a rearward portion of said upper rotating body;

winches arranged at the rearward portion of the upper rotating body, at least two winches of said winches being arranged to be overlapped vertically with each other; and guide sheaves for guiding guide ropes from said winches to a front part of said boom, wherein centers of rotation of all of said winches are arranged rearward of said swinging axis and below said guide sheaves, wherein said upper rotating body includes a rotating frame and a rotation bearing provided at a bottom surface of a front part of said rotating frame, said rotation bearing supporting said upper rotating body rotatably, wherein said winches are arranged at a rear part of said rotating frame, and wherein a lower end of a winch arranged at the lowest part of said winches is lower than the bottom surface of the front part of said rotating frame.

11. A construction machine, in which an upper rotating body is mounted rotatably on a lower traveling body, a boom is arranged on said upper rotating body to be raised and lowered about a swinging axis, the swinging axis of said boom being mounted to a rearward portion of said upper rotating body, and a plurality of winches are arranged at the rearward portion of said upper rotating body and not on said boom, said plurality of winches are arranged to be overlapped vertically, further comprising guide sheaves for guiding guide ropes from said winches to a front part of said boom, wherein centers of rotation of all of said winches are arranged rearward of said swinging axis and below said guide sheaves.

12. The construction machine according to claim 11, wherein all of said winches are vertically overlapped with each other.

* * * * *